US007927146B2

(12) United States Patent
Wu et al.

(10) Patent No.: US 7,927,146 B2
(45) Date of Patent: Apr. 19, 2011

(54) CABLE ASSEMBLY WITH SHIELDING MEMBER

(75) Inventors: Xiao-Gang Wu, Kunshan (CN); Ping-Sheng Su, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/635,717

(22) Filed: Dec. 11, 2009

(65) Prior Publication Data

US 2010/0151734 A1 Jun. 17, 2010

(30) Foreign Application Priority Data

Dec. 11, 2008 (CN) ..... 2008 1 0306120

(51) Int. Cl.
*H01R 13/648* (2006.01)

(52) U.S. Cl. ..... 439/607.57; 439/607.58

(58) Field of Classification Search ..... 439/607.41, 439/607.57, 607.58
See application file for complete search history.

(56) References Cited

U.S. PATENT DOCUMENTS

| | | | | |
|---|---|---|---|---|
| 6,162,086 | A * | 12/2000 | Kuo | 439/497 |
| 6,280,252 | B1 * | 8/2001 | Huang | 439/607.48 |
| 6,821,151 | B2 * | 11/2004 | Lai | 439/607.51 |
| 6,929,512 | B2 * | 8/2005 | Lai | 439/607.27 |
| 6,955,568 | B1 * | 10/2005 | Wu | 439/660 |
| 7,160,120 | B2 * | 1/2007 | Zhang et al. | 439/79 |
| 7,160,153 | B1 * | 1/2007 | Huang | 439/607.44 |
| 7,217,142 | B1 * | 5/2007 | Wu | 439/79 |
| 7,306,479 | B1 * | 12/2007 | Wu | 439/497 |
| 7,540,773 | B2 * | 6/2009 | Ko | 439/581 |
| 2002/0086581 | A1 * | 7/2002 | Chen et al. | 439/607 |
| 2005/0130496 | A1 * | 6/2005 | Ko | 439/610 |

* cited by examiner

*Primary Examiner* — Briggitte R Hammond
(74) *Attorney, Agent, or Firm* — Wei Te Chung; Andrew C. Cheng; Ming Chieh Chang

(57) ABSTRACT

A cable assembly (100) comprises a first shielding member (1) and a second shielding member (4) assembled together along a front-to-back direction; an insulative housing (2) with a plurality of terminals (3), the insulative housing accommodated in the first shielding member; a cable (7) having a plurality of wires electrically connected to the terminals, respectively; a strain relief member (6) combined with the cable, the strain relief member retained in the second shielding member.

20 Claims, 5 Drawing Sheets

CABLE ASSEMBLY WITH SHIELDING MEMBER

BACKGROUND OF THE INVENTION

1. Field of the Invention

The present invention generally relates to cable assembly, and more particularly to a cable assembly for high-speed transmission.

2. Description of Related Art

HDMI (High-definition Digital Multimedia Interface) connector has become a main interconnection interface for consumer device, since it is defined by HDMI commission in April, 2002. An conventional HDMI cable connector includes an insulative housing, a plurality of contacts supported by the insulative housing, a metallic shell shielding the insulative housing, a cable with wires therein terminated to the contacts. In addition, an insulator is molded over connection area between the contacts and the wires to enhance mechanical connection therebetween. However, the plastic material of the melted insulator may extrude into terminal passages, and result in some problems.

Hence, an improved cable assembly is highly desired to overcome the disadvantages of the related art.

SUMMARY OF THE INVENTION

Accordingly, an object of the present invention is to provide a cable assembly with an improved shielding member.

In order to achieve the object set forth, a cable assembly in accordance with the present invention comprises a die-cast first shielding member having a base portion and a mating portion connected with a front wall of the base portion; an insulative housing with a plurality of terminals, the insulative housing accommodated in the first shielding member; and a cable having a plurality of wires electrically connected to the terminals, respectively.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
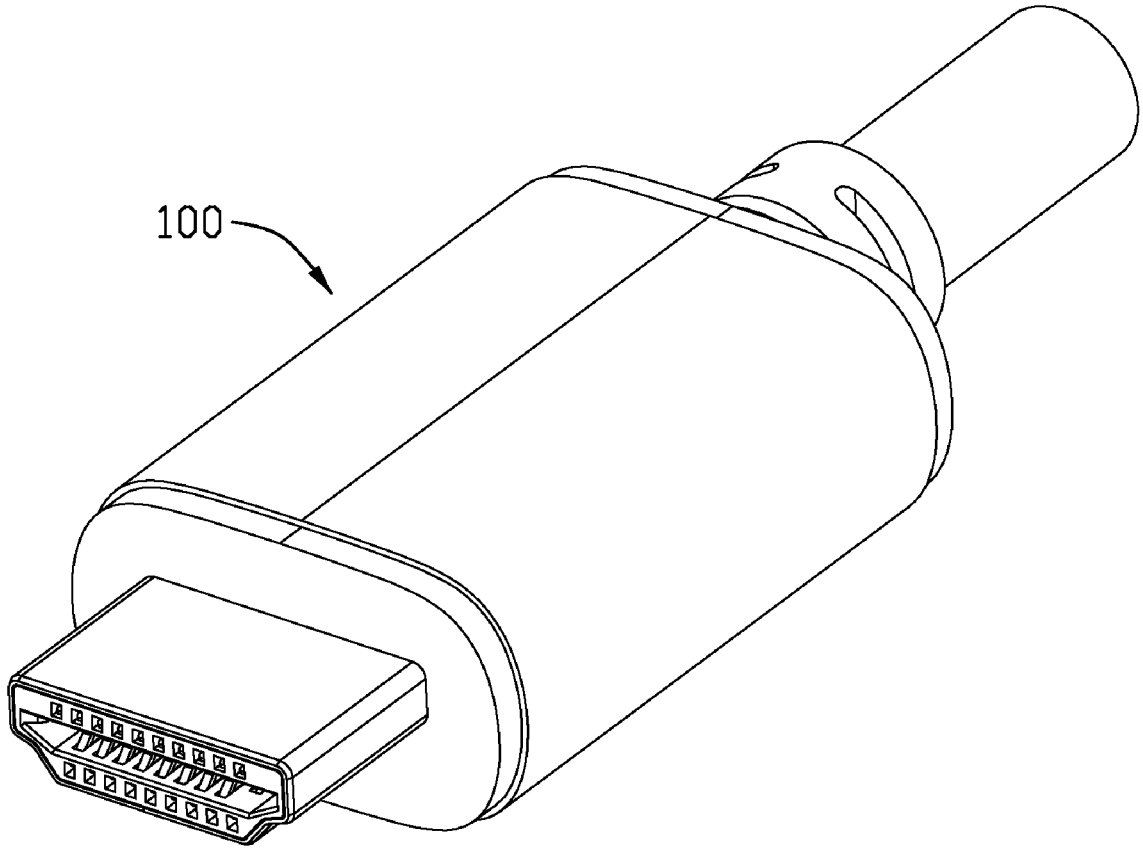
FIG. 1 is an assembled, perspective view of a cable assembly.
Figure 2:
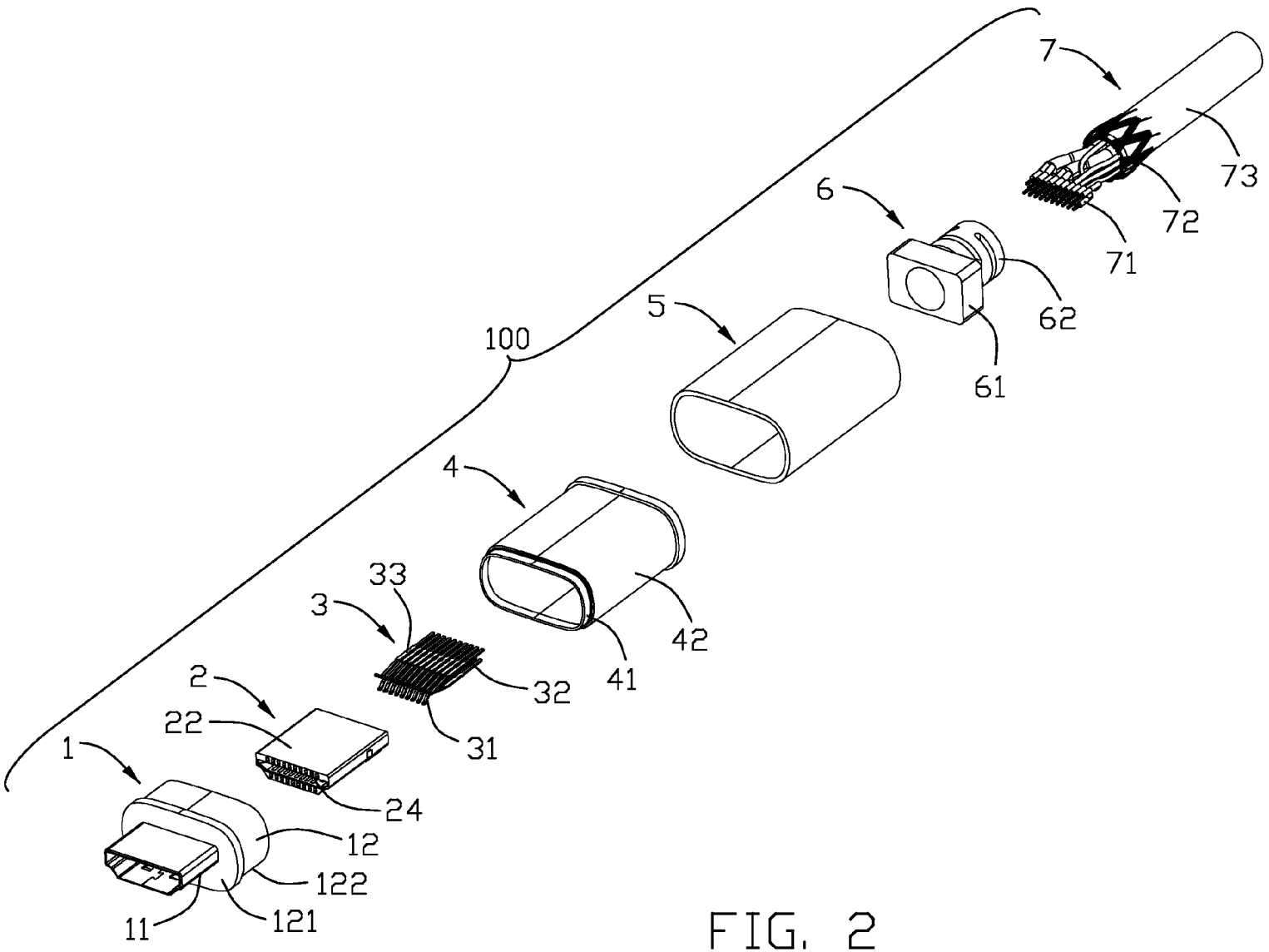
FIG. 2 is an exploded, perspective view of the cable assembly.
Figure 3:
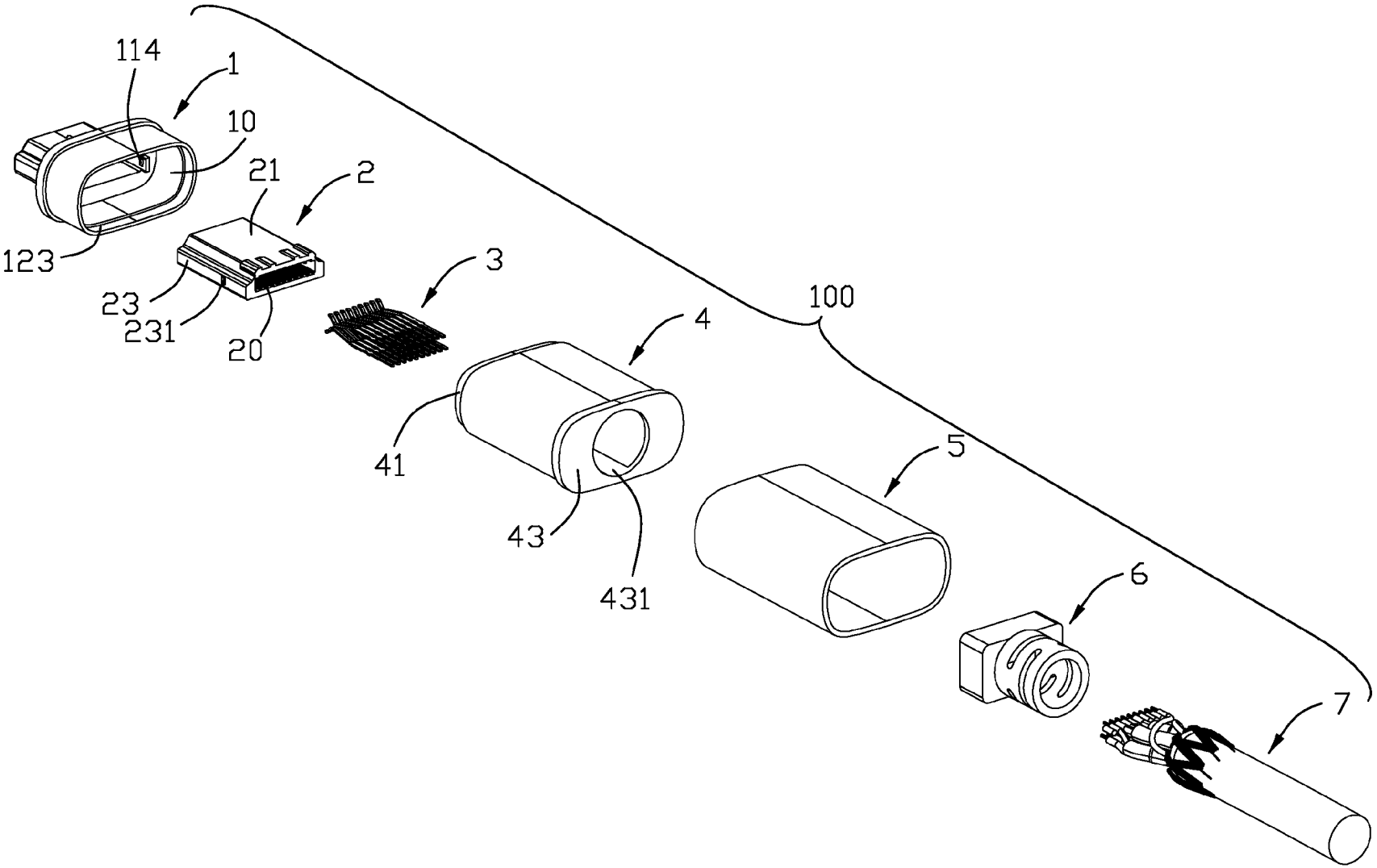
FIG. 3 is a view similar to FIG. 2, but viewed from another aspect.
Figure 4:
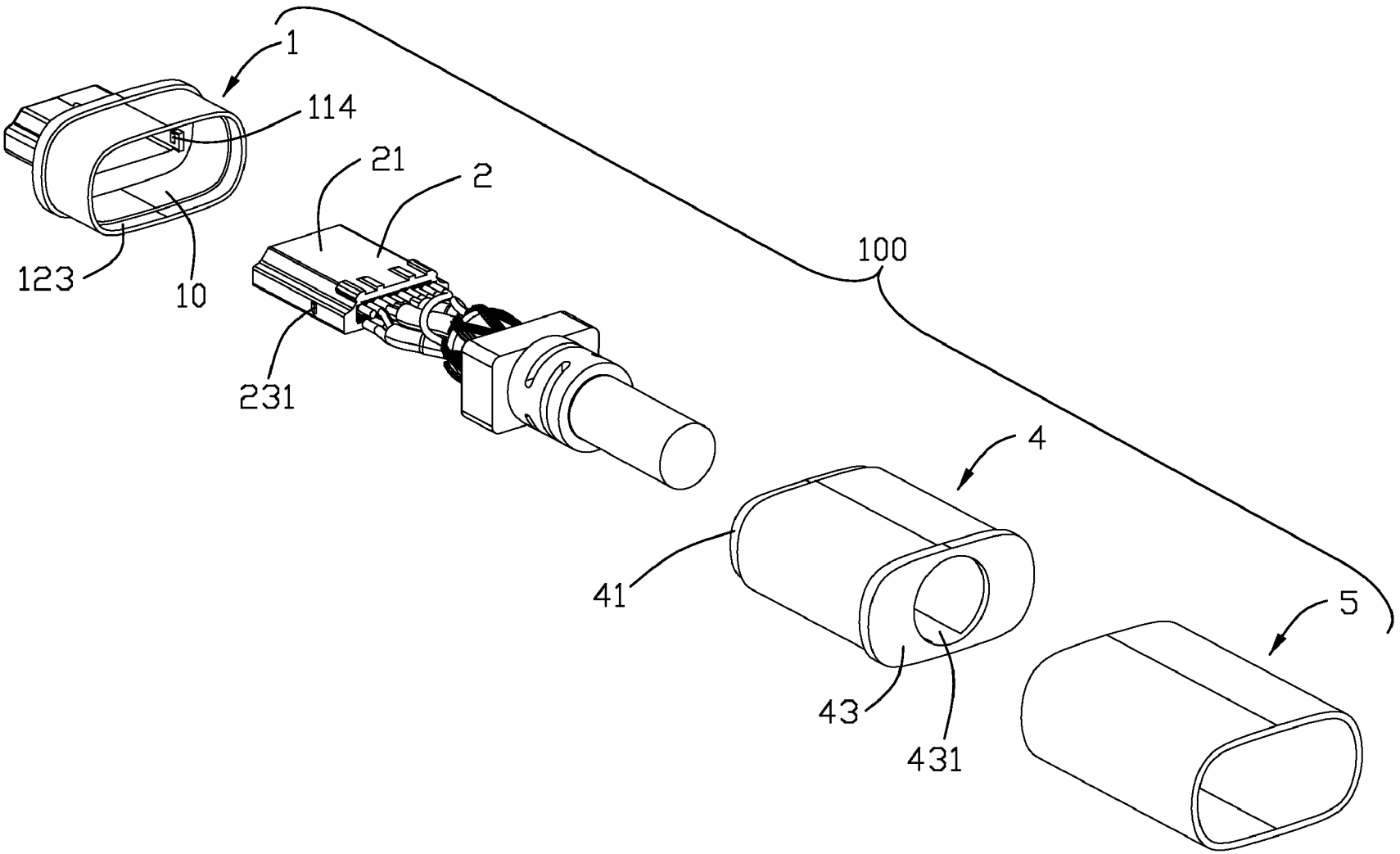
FIG. 4 is a partially exploded, perspective view of the cable assembly.
Figure 5:
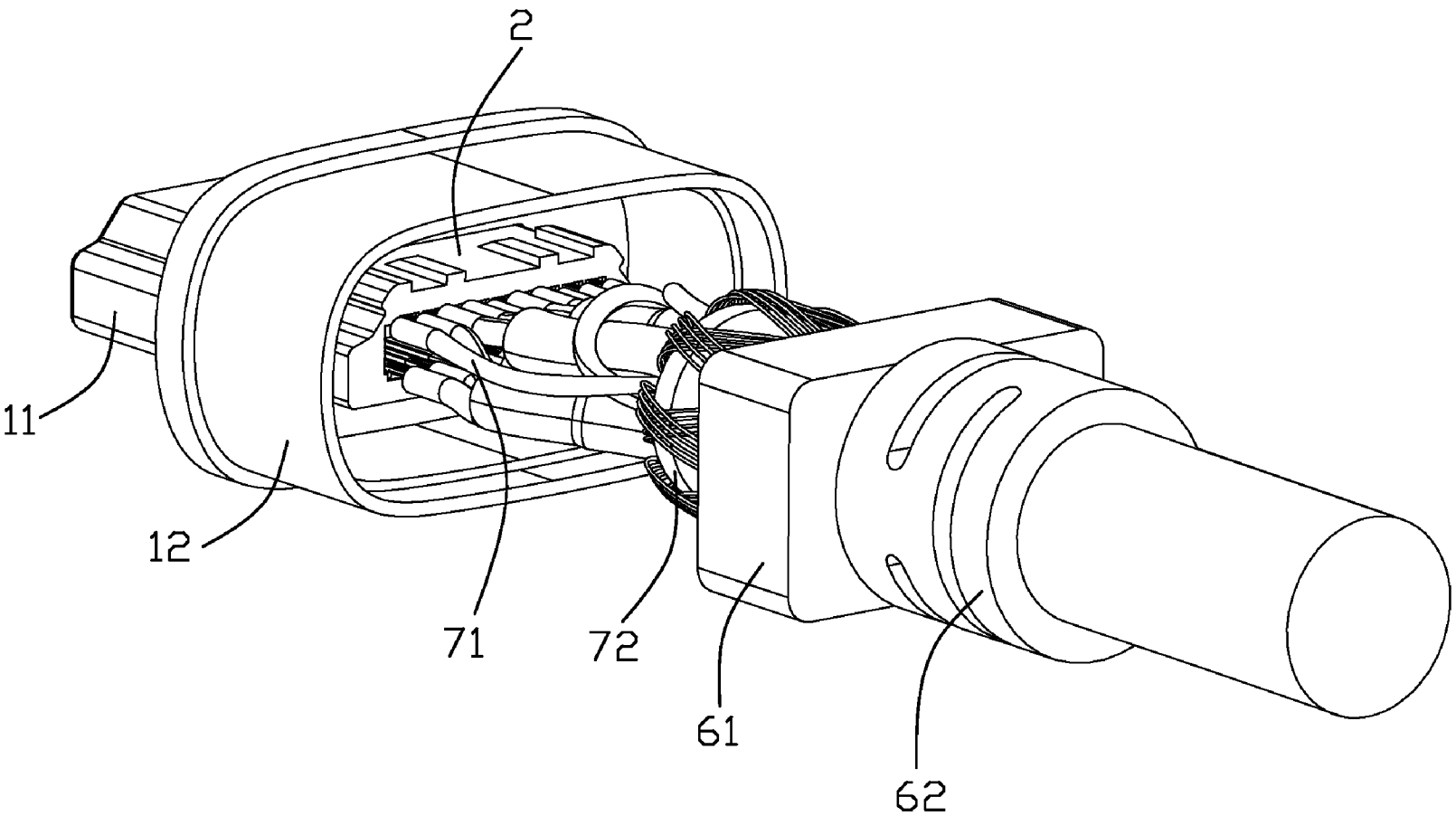
FIG. 5 is another partially exploded, perspective view of the cable assembly.

Referring to FIGS. 1-5, a cable assembly 100 in accordance with the present invention includes a first shielding member 1, an insulative housing 2 received in the first shielding member 1, a plurality of terminals 3 supported by the insulative housing 2, a second shielding member 4, a cover 5, a strain relief member 6 and a cable 7.

The first shielding member 1 is a metallic die-cast member. The first shielding member 1 is configured to an one-piece type and has a base portion 12 connected with a mating portion 11. The base portion 12 has a front wall 121 and a hollowed peripheral wall 122 extending rearwardly from a back surface of the front wall 121. A loop-shaped recess 123 is defined in an inner side of a rear segment of the peripheral wall 122. The mating portion 11 projects forwardly from a front surface of the front wall 121. A positioning cavity 114 is defined in an inner of a lateral side of the mating portion 11. The positioning cavity 114 is disposed adjacent to the base portion 12. A receiving space 10 is enclosed by the base portion 12 and the mating portion 11.

The insulative housing 2 includes a top side 21, a bottom side 22 and a pair of lateral sides 23 connected to the top side 21 and the bottom side 22 to form a channel 20 thereamong. Two tabs 231 are formed on the pair of lateral sides 23, respectively. The insulated housing 2 is accommodated in the receiving space 10 of the first shielding member 1, with tabs 231 projecting into positioning cavities 114.

The terminals 3 are separated into two distinct rows along up-to-down direction and assembled to the top side 21 and the bottom side 22 of the insulative housing 2. Each terminal 3 has a planar retention portion 22 engaged with terminal slots 20 defined in top side 21 or bottom side 22, a contacting portion 31 extending forwardly from the retention portion 22 and projecting into the channel 20, and a tail portion 32 extending rearwardly from the retention portion 22 and disposed behind the back edge of the insulative housing 2.

The cable 7 includes a plurality of wires 71 respectively terminated to the tail portions 32 of the terminals 3, a metallic braiding 72 shielding the wires 71 and a insulative jacket 73 enclosing the metallic braiding 72. The strain relief member 6 has a base portion 61 and boot 62. The strain relief member 6 is combined with the insulative jacket 73 of the cable 7 by molding process.

The second shielding member 4 is made of metallic material and includes a hollowed body portion 42, mounting portion 41 is arranged at a front edge of the body portion 42 and a rear wall 43 connected to a back edge of the body portion 42. The mounting portion 41 is smaller than the body portion 42 and assembled to the loop-shaped recess 123 of the first shielding member 1 along a front-to-back direction. The rear wall 43 is larger than the body portion 42. The strain relief member 6 is accommodated in the hollowed body portion 42, with the base portion of the strain relief member 6 received in the hollowed body portion 42 and blocked by the rear wall 43, and the boot 62 protruding outside via a hole 431 defined in the rear wall 43.

The cover 5 encloses the base portion 12 of the first shielding member 1 and the body portion 42 of the second shielding member 2. The front wall 121 of the first shielding member 1 and the rear wall 43 both abut against front and rear edges of the cover 5, therefore the cover 5 is sandwiched between the front wall 121 and the rear wall 43.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a die-cast first shielding member having a base portion and a mating portion connected with a front wall of the base portion;

an insulative housing with a plurality of terminals, the insulative housing accommodated in the first shielding member; and a cable having a plurality of wires electrically connected to the terminals, respectively;

a second shielding member assembled to the first shielding member along a front-to-back direction;

wherein the first shielding member and the second shielding member both only have a front opening and a rear opening.

2. The cable assembly as claimed in claim 1, wherein a tab is formed on the insulative housing and locked into a positioning cavity defined in an inner of the mating portion of the first shielding member.

3. The cable assembly as claimed in claim 2, wherein the positioning cavity is disposed adjacent to the base portion of the first shielding member.

4. The cable assembly as claimed in claim 1, wherein the second shielding member has a hollowed body portion with a mounting portion arranged at a front edge thereof and inserted into a loop-shaped recess defined in an inner side of a rear segment of the first shielding portion.

5. The cable assembly as claimed in claim 4, wherein a strain relief member combined with the cable, the strain relief member retained in the second shielding member.

6. The cable assembly as claimed in claim 5, wherein the second shielding member has a rear wall connected to the body portion thereof, and the strain relief member is blocked by the rear wall.

7. The cable assembly as claimed in claim 6, wherein the rear wall of the second shielding member defines a hole, and the strain relief member has a base portion located in front of the rear wall and a boot extending outside via the hole.

8. The cable assembly as claimed in claim 6, wherein a cover encloses the base portion of the first shielding member and body portion of the second shielding member.

9. The cable assembly as claimed in claim 8, wherein the cover is sandwiched between the front wall of the first shielding member and a rear wall of the second shielding member.

10. The cable assembly as claimed in claim 1, wherein the terminals are divided into distinct rows along a up-to-down direction and mounted to a top and bottom sides of the insulative housing.

11. The cable assembly as claimed in claim 1, wherein the second shielding member is made of metallic material.

12. The cable assembly as claimed in claim 8, wherein the cover is tubular shaped member.

13. A cable connector assembly comprising:

a first metallic shielding member essentially being of a tubular configuration with a small front section and large rear section;

an electrical connector including an insulative housing and defining a mating portion snugly received in the small front section, and a plurality of contacts disposed in the mating portion;

a second metallic shielding member essentially being of tubular configuration similar to said large rear section, said second shielding member compliantly coupling to said large rear section and opposite to the small front section;

a cable including a plurality of wires mechanically and electrically connected to the corresponding contacts, respectively; and a strain relief member circumferentially enclosing said wires; wherein said second metallic shielding member includes a rear wall which said strain relief member is engaged with; wherein said second shielding member defines a front flange circumferentially enclosed in said large rear section.

14. The cable connector assembly as claimed in claim 13, wherein said cable is equipped with braiding mechanically and electrically connected to the second shielding member.

15. The cable connector assembly as claimed in claim 13, wherein said housing extends in a front-to-back direction essentially with a constant cross-section thereof.

16. The cable connector assembly as claimed in claim 13, further including an insulative cover enclosing circumferentially the second shielding member.

17. The cable connector assembly as claimed in claim 16, wherein said cover defines a constant cross-section axially while said first shielding member and said second shielding member do not have constant cross-section axially.

18. A cable assembly, comprising:

a die-cast first shielding member having a base portion and a mating portion connected with a front wall of the base portion;

an insulative housing with a plurality of terminals, the insulative housing accommodated in the first shielding member; and a cable having a plurality of wires electrically connected to the terminals, respectively;

further comprising a second shielding member assembled to the first shielding member along a front-to-back direction; wherein the second shielding member has a hollowed body portion with a mounting portion arranged at a front edge thereof and inserted into a loop-shaped recess defined in an inner side of a rear segment of the first shielding portion; wherein a strain relief member combined with the cable, the strain relief member retained in the second shielding member; wherein the second shielding member has a rear wall connected to the body portion thereof, and the strain relief member is blocked by the rear wall.

19. The cable assembly as claimed in claim 18, wherein the rear wall of the second shielding member defines a hole, and the strain relief member has a base portion located in front of the rear wall and a boot extending outside via the hole.

20. The cable assembly as claimed in claim 18, wherein a cover encloses the base portion of the first shielding member and body portion of the second shielding member.

* * * * *